United States Patent [19]

Murakami et al.

[11] Patent Number: 4,983,936

[45] Date of Patent: Jan. 8, 1991

[54] FERROMAGNETIC RESONANCE DEVICE

[75] Inventors: Yoshikazu Murakami; Takahiro Ogihara; Tsutomu Okamoto; Kanako Niikura, all of Kanagawa, Japan

[73] Assignee: Sony Corporation, Tokyo, Japan

[21] Appl. No.: 312,391

[22] Filed: Feb. 21, 1989

Related U.S. Application Data

[63] Continuation of Ser. No. 69,024, Jul. 1, 1987, abandoned.

[30] Foreign Application Priority Data

Jul. 2, 1986 [JP] Japan ..... 1-55624
Jul. 2, 1986 [JP] Japan ..... 1-55625
Jul. 2, 1986 [JP] Japan ..... 1-55626

[51] Int. Cl.[5] ..... H01P 1/215

[52] U.S. Cl. ..... 333/202; 333/205; 333/219.2; 333/235

[58] Field of Search ..... 333/202, 204, 205, 219, 333/219.2, 222, 223, 235, 24.2, 245-247, 148, 161; 310/26; 331/96, 107 SL, 107 DP

[56] References Cited

U.S. PATENT DOCUMENTS 4,197,517 4/1980 Vittoria ..... 333/205
4,291,283 9/1981 Castera ..... 331/96
4,555,683 11/1985 Sorger et al. ..... 333/202
4,679,015 7/1987 Murakami et al. ..... 333/219.2
4,743,874 5/1988 Kinoshita et al. ..... 333/219

FOREIGN PATENT DOCUMENTS 1585737 3/1981 United Kingdom .

OTHER PUBLICATIONS

20th Conf. on Magnetism and Magnetic Materials, Owens et al., p. 497, lines 3-9, 39-41, FIG. 2.

1985 IEEE MTT-5 International Microwave Symposium—Digest, St. Louis, Mo., Jun. 4-6, 1985, pp. 285-288, IEEE New York, U.S.; Y. Murakami et al., p. 285, lines 24-39, FIG. 1, "A bandpass filter using YIG . . . ".

Radio-Fernsehen Elektronik, vol. 31, No. 10, Oct. 1982, p. 661—Berlin-Est. DD: YIG—Bauerlemente Unded—Funktionsgruppen, FIG. 4.

Bell Systems Tech. Journal, vol. 48, No. 5, May/Jun. 1969, pp. 1421-1444, M. V. Schneider, "Microstrip liens . . . ", p. 1424, lines 7-25, FIG. 1e, 1f, 1g.

*Primary Examiner*—Eugene R. LaRoche
*Assistant Examiner*—Seung Ham
*Attorney, Agent, or Firm*—Hill, Van Santen, Steadman & Simpson

[57] ABSTRACT

A ferromagnetic resonance device is disclosed which utilize the perpendicular resonance of ferrimagnetic YIG thin film operable under a D.C. bias magnetic field perpendicular to a major surface of the YIG thin film element. By making the YIG thin film to have a major surface thereof (100) crystal plane of YIG or (111) crystal plane of a substituted YIG having reduced Ku value, lower limit of resonance frequency is extremely lowered. Thus wide range variable filter device can be obtained.

14 Claims, 9 Drawing Sheets

FERROMAGNETIC RESONANCE DEVICE

This is a continuation of application Ser. No. 069,024, filed July 1, 1987, now abandoned.

BACKGROUND OF THE INVENTION

The present invention relates to a ferromagnetic resonance device suitable for use with a microwave filter or a microwave oscillator, and particularly to a ferrimagnetic resonance device utilizing ferrimagnetic resonance of YIG (yttrium iron garnet) thin film.

Conventionally, a magnetic resonance element for a microwave device such as a filter or an oscillator utilizing ferrimagnetic resonance of YIG employs a spherical body prepared from a bulk single crystal of YIG. However, a lower limit of resonance frequency of the spherical body is relatively high owing to the demagnetizing field, and for instance, it is 1680 MHz in case of using an unsubstituted YIG sphere having a saturation magnetization of 1800 G (gauss). Thus, the prior art has not yet attained a microwave device capable of operating in a range down to a UHF band. On the other hand, the lower limit of resonance frequency may be reduced by partially substituting a non-magnetic ion such as $Ga^{3+}$ for $Fe^{3+}$ in YIG and thereby decreasing the saturation magnetization. In this case, if an amount of substitution is too large, a half width $\Delta H$ of resonance is increased to cause deterioration in characteristics of the device.

In another technique, it has been proposed that a microwave device utilizing ferrimagnetic resonance is provided by forming a YIG thin film on a GGG (gadolinium gallium garnet) substrate by liquid phase epitaxial growth (which will be hereinafter referred to as LPE) and working the thin film into a desired pattern such as a circular or rectangular shape by photolithography. As such a microwave device may be prepared as a microwave integrated circuit (which will be hereinafter referred to as MIC) using a micro-strip line or the like for a transmission line, the device is easily mounted in a magnetic circuit for applying a D.C. bias magnetic field. Further, as the device is produced by using LPE and photolithography, mass-produceability is improved. Such ferromagnetic resonance device utilizing YIG thin film is shown in U.S. Pat. Nos. 4,547,754, 4,626,800, 4,636,756, U.S. Ser. Nos. 708,851 filed Mar. 6, 1985, 740,899 filed June 3, 1985, 844,984 filed Mar. 27, 1986, 883,605 filed July 9, 1986 and 833,603 filed July 9, 1986, all assigned to the assignee of the present application. Additionally, the use of the thin-film element can greatly reduce the lower limit of resonance frequency as compared with a spherical element. However, in such a magnetic resonance device using the YIG thin film element, a detailed investigation intended to reduce the lower limit of resonance frequency to an ultimate value has not yet been reported.

As is mentioned above while the investigation for reducing the lower limit of resonance frequency to an ultimate value has not yet been established, an exemplary method of reducing the lower limit to an ultimately low frequency is to strengthen connection between the YIG thin film element and the transmission line and thereby sufficiently decrease an external Q value of a resonator. That is, since an unloaded Q value of a YIG resonator is lowered in a low frequency, it is necessary to sufficiently reduce the external Q value, so as to enlarge to some extent a reflection amplitude in case of a reflection type or a transmission amplitude in case of a transmission type.

FIG. 10 shows a structure of a YIG thin film resonance device of a YIG thin film type band-pass filter. In this structure, a ground conductor 2 is formed on one of principal planes (which will be hereinafter referred to as a first principal plane) of a dielectric substrate 1 such as an alumina substrate, and first and second parallel micro-strip lines 3 and 4 acting as input and output transmission lines, respectively, are formed on the other principal plane (which will be hereinafter referred to as a second principal plane). The micro-strip lines 3 and 4 are connected at their ends through first and second connecting conductors 5 and 6, respectively, to the ground conductor 2. First and second YIG thin film elements 7 and 8 as a magnetic resonance element are arranged on the second principal plane of the substrate 1, and are electromagnetically connected to the first and second micro-strip lines 3 and 4, respectively. These YIG thin film elements 7 and 8 are prepared by forming a YIG thin film on one of principal planes of a non-magnetic GGG substrate 9 by the afore-mentioned thin film forming technique and making a desired pattern such as a circular shape of the thin film by a selective etching using photolithography technique, for example. A third micro-strip line 10 as a connecting transmission line for electromagnetically connecting the first and second YIG thin film elements 7 and 8 as the first and second magnetic resonance elements with each other is formed on the other principal plane of the GGG substrate 9. The third micro-strip line 10 is connected at its both ends through third and fourth connecting conductors 11 and 12, respectively, to the ground conductor 2. The shown structure in FIG. 10 is placed in a D.C. bias magnetic field applied perpendicular to a major surface of the YIG thin film element, though the bias magnetic field applying structure is not shown in FIG. 10.

However, as the connection between the microstrip lines and the YIG thin film elements is not so strong, the external Q value cannot be reduced to such an extent as to be required by a low-frequency operation. In the case of the YIG thin film elements 7 and 8 having a diameter of 2.5 mm and a thickness of 25 $\mu$m, an external Q value $Q_{e1}$ due to the connection between the YIG thin film elements 7 and 8 and the input and output transmission lines 3 and 4 was 200, while an external Q value $Q_{e2}$ due to the connection between the YIG thin film elements 7 and 8 and the connecting transmission line 10 was 250. In order to further reduce these external Q values, it is necessary to enlarge the volume of the YIG thin film elements 7 and 8. However, if the diameter of the elements 7 and 8 were made so large in comparison with a width of the microstrip lines as the transmission lines, a spurious characteristic would be deteriorated. Further, if the thickness of the elements 7 and 8 were increased, a resonance frequency would be disadvantageously increased.

OBJECT AND SUMMARY OF THE INVENTION

It is an object of the present invention to provide an improved ferromagnetic resonance device.

It is another object of the present invention to provide a ferromagnetic resonance device utilizing YIG thin film element operable extremely low resonance frequency limit.

It is further object of the present invention to provide a ferromagnetic resonance device operable in wide range of frequency.

According to one aspect of the present invention, there is provided a ferromagnetic resonance device comprising a YIG thin film element formed on a non-magnetic substrate, said YIG thin film element having a major surface formed of (100) plane, a transmission line coupled to said YIG thin film element, and a bias magnetic field means applying a bias magnetic field perpendicular to said major surface.

According to another aspect of the present invention, there is provided a ferromagnetic resonance device comprising a YIG thin film element formed on a non-magnetic substrate, said YIG thin film element having a major surface formed of (111) plane and having a uniaxial magnetic anisotropy constant Ku smaller than the uniaxial magnetic anisotropy of pure YIG thin film element formed on a GGG (gadolinium-gallium-garnet) substrate, a transmission line coupled to said YIG thin film element, and a bias magnetic field means applying a bias magnetic field perpendicular to said major surface.

DESCRIPTION OF THE PREFERRED EMBODIMENTS

Figure 1:
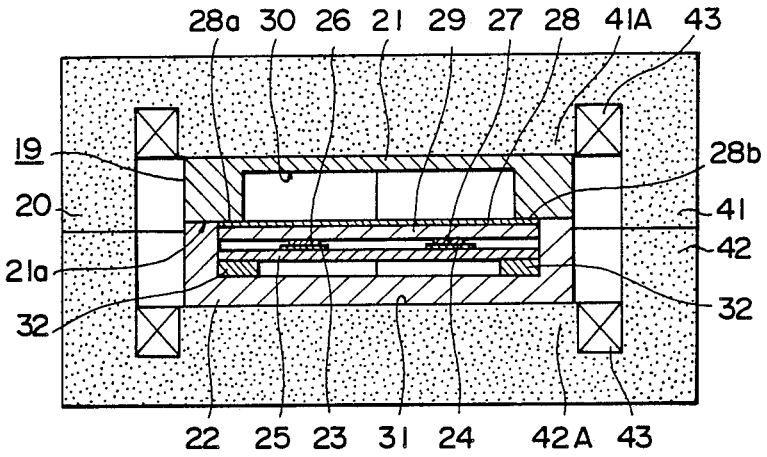
FIG. 1 is a sectional view of a preferred embodiment of the present invention.

According to the present invention, by using a YIG thin film element having a major surface formed of (100) plane or (111) plane having a reduced Ku value, a lower limit $\omega_{min}$ of resonance frequency may be reduced.

There will be now described the operation in detail.

The lower limit $\omega_{min}$ of resonance frequency of a ferrimagnetic single crystal depends on two factors of demagnetizing field and anisotropy field. Therefore, it is necessary to consider both the factors, so as to reduce the lower limit $\omega_{min}$ to an ultimate value.

First, the demagnetizing field is considered. For the purpose of simplicity, a spheroid sample is considered. When the sample is arranged in a D.C. magnetic field Ho in such a manner that the magnetic field Ho lies in the axial direction of the sample, an internal D.C. magnetic field Hi is expressed as follows:

$$Hi = Ho - Nz \cdot 4\pi Ms \quad (1)$$

Where, Nz is a demagnetization factor in the axial direction; and $4\pi Ms$ is a saturation magnetization. Resonance frequency $\omega$ in this sample is given by Kittel's equation as follows:

$$\omega = \gamma\{Ho - (Nz - N_T) \cdot 4\pi Ms\} \quad (2)$$

Where, $\gamma$ is a gyromagnetic ratio; and $N_T$ is a demagnetization factor in a transverse direction. The following equation is given from Equations (1) and (2).

$$\omega = \gamma(Hi + N_T 4\pi Ms) \quad (3)$$

In this case, unless magnetization of the sample is saturated, a single magnetic domain is not provided, and accordingly, a magnetic resonance loss is rapidly increased. Therefore, a condition for saturating the sample, that is, the internal D.C. magnetic field $Hi > 0$ is required. Even if the internal magnetic field required for saturating the sample is ignored, the resonance frequency is not lowered below the following value.

$$\omega_{min} = \gamma N_T 4\pi Ms \quad (4)$$

In case of a spherical YIG resonance element, $N_T = \frac{1}{3}$ is given, and the lower limit of resonance frequency is 1680 MHz ($\gamma = 2.8$ MHz/Oe) for an unsubstituted YIG having saturation magnetization of 1800 G, while it is 560 MHz when a trivalent non-magnetic Ga ion $Ga^{3+}$ is partially substituted for a trivalent Fe ion $Fe^{3+}$ so as to reduce the saturation magnetization to 600 G.

In case of a circular YIG thin film disc, as a shape of the disc is not a complete spheroid, and the internal D.C. magnetic field is not uniform, the operation is different from that of the above case. Though, a resonance frequency obtained from a magnetostatic mode theory (cf., Y. Ikusawa and K. Abe; "Resonant Modes of Magnetostatic Waves in a Normally Magnetized Disk", Japan Applied Physics 48, 3001 (1977) can be expressed in the same fashion as of Equation (2). In this case, $Nz - N_T$ is dependent upon an aspect ratio (thickness/diameter) of the thin film disc. The internal D.C. magnetic field Hi is minimum at the center of the disc. Supposing that the minimum value of Hi is expressed as follows:

$$Hi = Ho - Nz' \cdot 4\pi Ms \quad (5)$$

Nz' denotes an effective demagnetizing factor at the center of the disc. The lower limit $\omega_{min}$ of resonance frequency is given from Equation (2) and (5) as follows:

$$\omega_{min} = \gamma\{Nz' - (Nz - N_T)\} \cdot 4\pi Ms = N_T \cdot 4Ms \quad (6)$$

Figure 6:
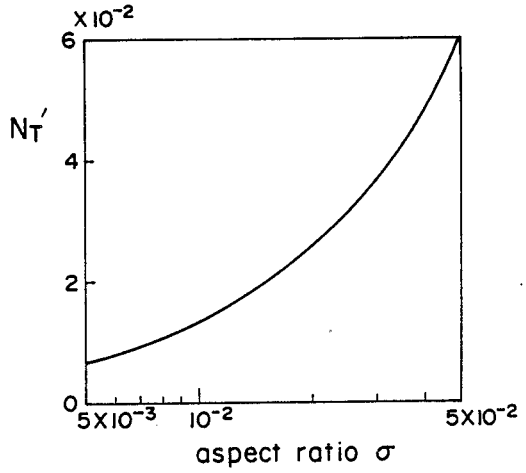
FIG. 6 is u a graph showing the relation between $N_T$ and aspect ratio $\sigma$.
Figure 7:
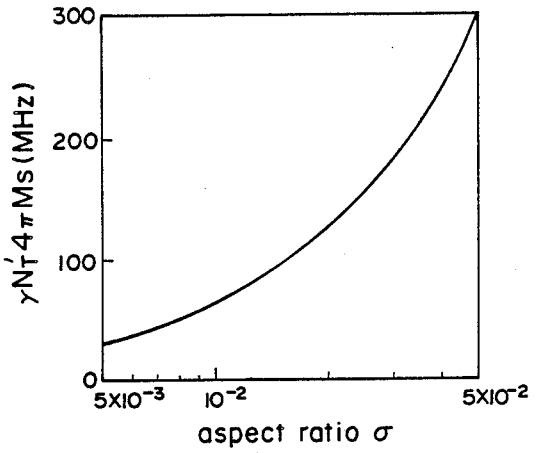
FIG. 7 is a graph showing the relation between $\gamma N_T 4\pi Ms$ and aspect ratio $\sigma$.

FIG. 6 shows the dependency of $N_T$ upon the aspect ratio $\sigma$, and FIG. 7 shows values of $\gamma N_T 4\pi Ms$ when $4\pi Ms$ is 1800 G. Typical values of $\gamma N_T 4\pi Ms$ are 63 MHz for $\sigma = 1 \times 10^{-2}$ (diameter: 2 mm; thickness: 20 $\mu$m) and 125 MHz for $\sigma = 2 \times 10^{-2}$. It is appreciated that these values are greatly small as compared with the above case of the spherical YIG element.

Next, the effect of the anisotropy field will be described.

Magnetic anisotropy of the YIG thin film formed by LPE includes crystal magnetic anisotropy and uniaxial magnetic anisotropy. Conditions of the YIG thin film having a (100) crystal plane for the principal plane and of the YIG thin film having a (111) crystal plane for the principal plane are given by the following equations as influenced by the afore-mentioned anisotropy field (cf., J. Smit and H. P. J. Wijn, "Ferrites", chap. 6, John Wiley & Sons, Inc., New York, 1959, and J. O. Artman, "Microwave Resonance Relations in Anisotropic Tropic Single Crystal Ferrites" Proc, IRE, 44, 1284, 1956).

Condition in case of a (100) crystal plane:

$$\omega = \gamma \quad (Hi + 2Ku/Ms - 2|K_1|/Ms) \quad (Hi \geqq 2|K_1|/Ms = 2Ku/Ms) \tag{7}$$

Condition in case of a (111) crystal plane:

$$\omega=\gamma(Hi+2Ku/Ms+4|K_1|/3Ms) \tag{8}$$

Where, $K_1$ is a primary cubic crystal magnetic anisotropy constant, which is a negative value in YIG; and Ku is an uniaxial anisotropy constant, which is inherent in a thin film rather than a bulk or YIG. The uniaxial anisotropy constant Ku consists of a magnetostriction anisotropy Ks to be generated because of mismatching between a lattice constant of the YIG thin film formed by LPE and a lattice constant of the GGG substrate and a growth induced magnetic anisotropy $K_G$ associated with non-uniform growth of the crystal of the YIG thin film. Actually, as the growth induced magnetic anisotropy $K_G$ is ignorably small, the magnetostriction anisotropy factor only is a subject of consideration. Since the lattice constant of the unsubstituted YIG is smaller than that of the GGG substrate, and magnetostrictive constants $\lambda_{111}$ and $\lambda_{100}$ are negative values, the magnetostriction anisotropy Ks is a positive value. On the other hand, a $Y^{3+}$ ion in YIG is partially substituted with a $La^{3+}$ ion to thereby attain matching between the lattice constant of the YIG thin film and that of the GGG substrate. Thus, Ks may be made substantially zero, and resultantly, Ku may be made substantially zero.

It is appreciated from Equation (7) that perpendicular resonance of the (100) film can rise from a frequency of zero. Further, the lower limit frequency $\omega_{min}$ of perpendicular resonance of the (111) film becomes 149 MHz when Ku=0 and $|K_1|/Ms=40$ Oe.

Summarizing the above, the lower limit frequency $\omega_{min}$ of perpendicular resonance of the YIG thin film disc is expressed as follows:

In case of using a (100) plane for the principal plane:

$$\omega_{min}=\gamma N_T 4\pi Ms \tag{9}$$

In case of using a (111) plane for the principal plane:

$$\omega_{min}=\gamma(N_T 4\pi Ms+2Ku/Ms+4|K_1|/3Ms) \tag{10}$$

While the YIG film element according to one aspect of the present invention uses a (100) plane for the principal plane, Equation (9) may be established by sufficiently reducing the magnetostrictive anisotropy and the growth induced magnetic anisotropy and thereby making the uniaxial anisotropy constant Ku equal or less than the absolute value of the primary cubic anisotropy constant $K_1$. Furthermore, when the aspect ratio is set to $5\times10^{-2}$ or less with reference to FIG. 6, the lateral demagnetization factor $N_T$ may be reduced to thereby reduce the lower limit frequency $\omega_{min}$ to an ultimate value.

In another aspect, it is appreciated that $\omega_{min}$ may be reduced according to the substituted YIG thin film element having Ku smaller than that of the unsubstituted YIG on the GGG substrate, and that $\omega_{min}$ may be further reduced to an ultimate value when Ku=0.

Further, as is appreciated from Equation (9), the lower limit frequency $\omega_{min}$ may be reduced by partially substituting a non-magnetic ion such as $Ga^{3+}$ ion for $Fe^{3+}$ ion in YIG and thereby reducing the saturation magnetization $4\pi$Ms.

While the above description is directed to the case where the primary cubic anisotropy constant $K_1$ is negative, conditions of perpendicular resonance when $K_1$ is positive are expressed as follows:

Condition in case of a (100) crystal plane:

$$\omega=\gamma(Hi+2Ku/Ms+2K_1/Ms) \tag{11}$$

Condition in case of a (111) crystal plane:

$$\omega = \gamma \quad (Hi + 2Ku/Ms - 4K_1/3Ms) \quad (Hi \geqq 4K_1/3Ms - 2Ku/Ms) \tag{12}$$

As is apparent from Equations (11) and (12), $\omega_{min}$ may be reduced by making Ku equal to or less than $(\frac{2}{3})K_1$ in using the (111) crystal plane.

Figure 8:
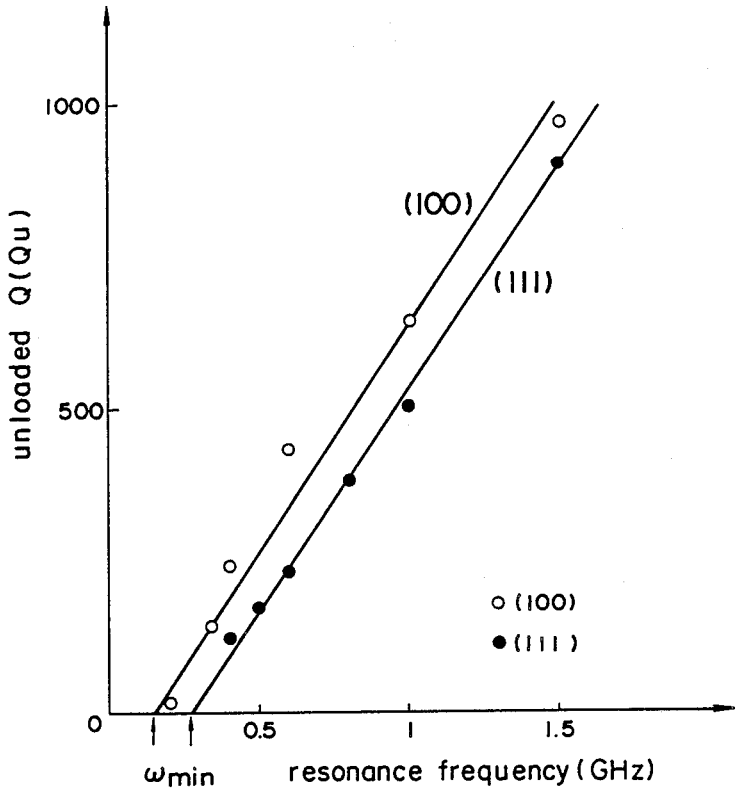
FIG. 8 is a graph showing the relation between resonance frequency and unloaded Q value.

Further, as is mentioned previously, the unloaded Q value may be increased by reducing the lower limit $\omega_{min}$ of resonance frequency. FIG. 8 shows a change in the unloaded Q value with respect to frequency. As is apparent from FIG. 8, Qu is proportional to frequency $\omega$, and Qu is zero at $\omega_{min}$. Qu may be expressed as follows:

$$Qu=\omega-\omega_{min})/\gamma\Delta H \tag{13}$$

As is appreciated from Equation (13), the unloaded Q value may be increased by greatly reducing $\omega_{min}$ when the frequency $\omega$ is fixed, thus improving characteristics. This effect is especially remarkably at low frequencies lower than 1 GHz.

In the ferromagnetic resonance device using the YIG thin film element of the present invention, an operation frequency may be reduced to an ultimately low frequency by reducing the external Q value Qe. There will be now described this matter in detail. First, in case of using a reflection type resonance device such as a YIG tuned oscillator, a reflection factor $S_{11}$ is given by the following equation, letting the unloaded Q value, the external Q value and the resonance frequency of the YIG resonance element be defined by Qu, Qe and $\omega$o, respectively.

$$S_{11} = \frac{1/Qe - 1/Qu - J(\omega/\omega o - \omega o/\omega)}{1/Qe + 1/Qu + j(\omega/\omega o - \omega o/\omega)} \tag{14}$$

$$= \frac{Qu/Qe - 1 - jQu(\omega/\omega o - \omega o/\omega)}{Qu/Qe + 1 + jQu(\omega/\omega o - \omega o/\omega)} \tag{15}$$

As is appreciated from Equation (15), the reflection factor is $-1$ when $\omega$ is sufficiently separated from $\omega$o, and it becomes $(Qu/Qe-1)/(Qu/Qe+1)$ when $\omega=\omega o$. When Qu>Qe, the YIG resonance element comes into an over-coupled condition, and the reflection factor draws a large loop in the vicinity of $\omega$o. On the other hand, since Qu is small at an ultimately low frequency as apparent from Equation (13), Qe must be reduced to a greatly low value so as to establish Qu>Qe.

Next, in case of using a transmission type resonance device such as a band-pass filter, a transmission factor $S_{21}$ of a one-stage band-pass filter is given by the following equation.

$$S_{21} = \frac{2//Qe1Qe2}{1/Qu + 1/Qe1 + 1/Qw2 + J(\omega/\omega o - \omega o/\omega)} \quad (16)$$

Substituting $Q_{e1}=Q_{e2}$ into Equation (16) for the purpose of simplicity, the following equation is given.

$$S_{21} = \frac{2Qu/Qe}{(2Qu/Qe) + 1 + jQu(\omega/\omega o - \omega o/\omega)} \quad (17)$$

As is appreciated from Equation (17), the transmission factor is zero when $\omega$ is sufficiently separated from $\omega_o$, and it becomes (2Qu/Qe)/(2Qu/Qe+1) when $\omega=\omega_o$. Accordingly, unless Qe is made sufficiently small in association with a reduced value of Qu at an ultimately low frequency, a transmission amplitude at $\omega=\omega_o$ cannot be enlarged to a certain extent. In other words, the operation frequency may be reduced to an ultimately low value by sufficiently decreasing the external Q value Qe.

EXAMPLE 1

Figure 9:
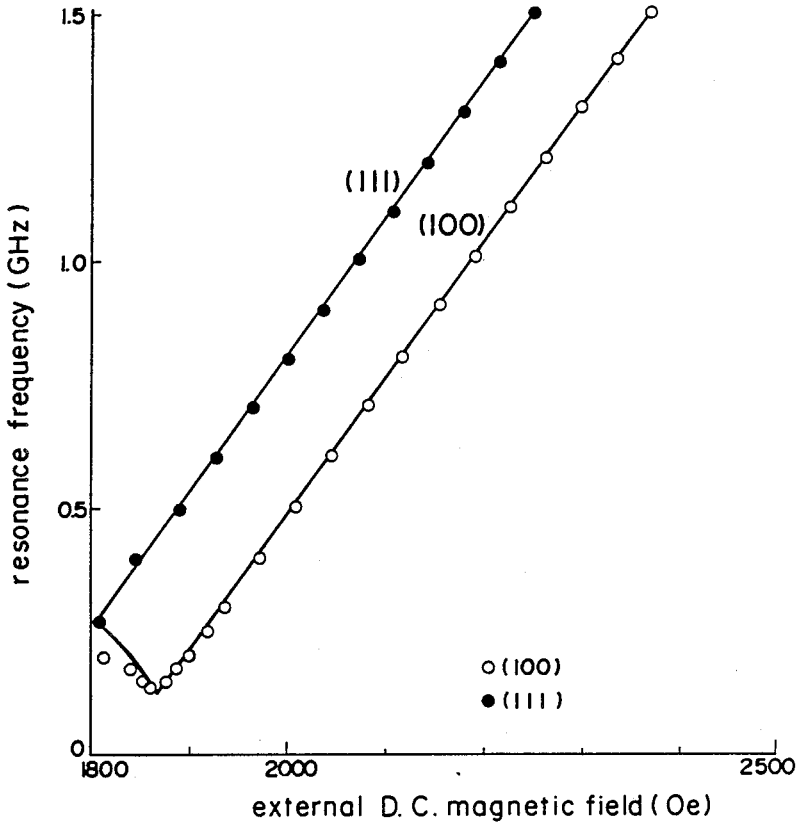
FIG. 9 is a graph showing the relation between external magnetic field and resonance frequency.
Figure 10:
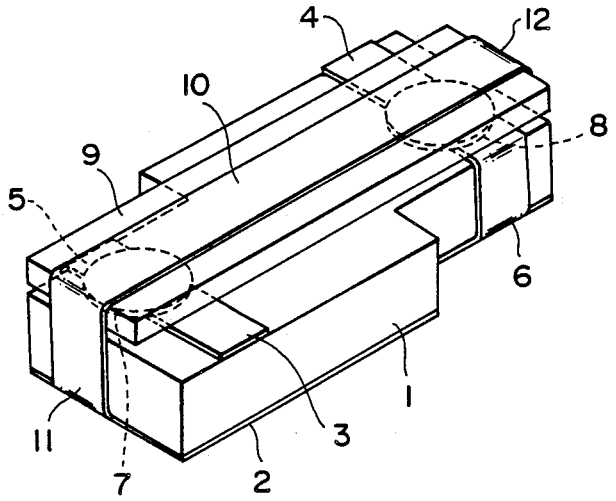
FIG. 10 (PRIOR ART)
FIG. 10 is a perspective view of the resonance device in the prior art.

A YIG thin film disc having a diameter of 2.5 mm and a thickness of 50 μm was prepared with its principal plane specified to a (100) plane, and a perpendicular resonance frequency was measured when an external D.C. magnetic field in a thickness direction of the YIG thin film disc is varied. The result of measurement is shown in FIG. 9 by plotting blank circles. A lower limit of resonance frequency was 140 MHz. Another YIG thin film disc having a diameter of 2.5 mm and a thickness of 50 μm was prepared with its principal plane specified to a (111) plane, and resonance frequencies are plotted by solid circles as shown in FIG. 9. In this case, a lower limit of resonance frequency was 270 MHz. These lower limits almost coincide with theoretical values 125 MHz and 274 MHz obtained from Equations (9) and (10). A curved solid line shown in FIG. 9 is a theoretical value curve drawn by using $4\pi Ms=1800$ G, $K_1=-5.7\times10^3$ erg/m$^3$, and $Ku=0.7\times10^3$ erg/cm$^3$ (provided that Ku is applied to the (100) plane only). It is appreciated that the condition of $Ku<|K_1|$ is satisfied in this example.

Figure 2:
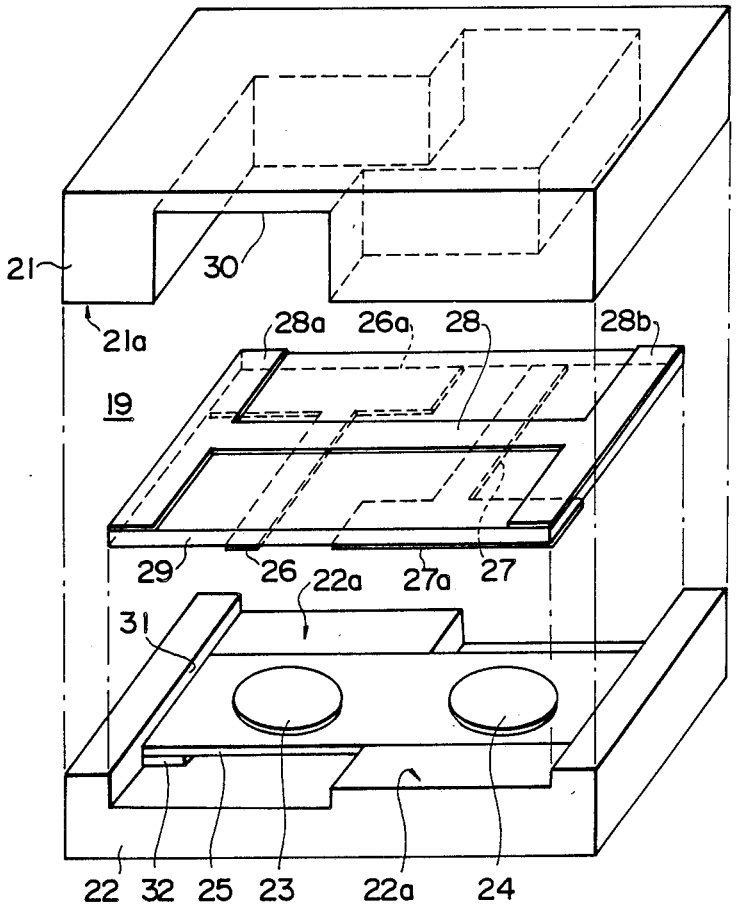
FIG. 2 is an exploded perspective view of the body of the device shown in FIG. 1.

Referring to FIGS. 1 and 2 which show an example of a two-stage band-pass filter of the YIG thin film type according to the present invention, reference numeral 19 designates a body of the device, and 20 designates a bias magnetic field applying means for applying a D.C. bias magnetic field to the body 19.

A transmission system in this example is constituted of a so-called suspended substrate strip line. That is, the body 19 includes a first conductor 21 and a second conductor 22, between which a nonmagnetic GGG substrate 25 and a dielectric substrate 29 are interposed. The non-magnetic GGG substrate 25 is provided with first and second disc-like YIG thin film elements 23 and 24. The dielectric substrate 29 is formed on its one surface with first and second strip lines 26 and 27 acting as input and output strip lines, respectively, and is further formed on the other surface with a third connecting strip line 28.

The strip lines 26 and 27 are so arranged as to be offset to the second conductor 22 in a position relatively near the same, so as to increase a high-frequency magnetic field between the strip lines and the second conductor 22. The YIG thin film elements 23 and 24 are so arranged as to contact with the strip lines 26 and 27, so as to strengthen the connection therebetween.

The first and second YIG thin film elements 23 and 24 are simultaneously prepared by forming a YIG thin film having a (100) crystal plane or a substituted YIG thin film having a (111) crystal plane as a principal plane by LPE on an entire surface of the non-magnetic GGG substrate 25 opposed to the dielectric substrate 29, and then etching off an unnecessary portion of the thin film by photolithography to obtain a desired size, shape and arrangement.

The dielectric substrate 29 is formed of ceramics such as alumina. The first and second strip lines 26 and 27 are deposited on one surface of the substrate 29 opposed to the YIG thin film elements 23 and 24 at a position facing thereto. The third strip line 28 is deposited on the other surface of the substrate 29 in such a manner as to intersect the strip lines 26 and 27 in opposed relationship thereto. Opposed ends 26*a* and 27*a* of the first and second microstrip lines 26 and 27 and both ends 28*a* and 28*b* of the third micro-strip line 28 are designed to act as ground terminals. The substrate 25 and 29 are interposed between the first and second conductors 21 and 22 to contact the conductor 21 or 22.

The first conductor 21 is formed at its lower surface with a relatively deep recess 30 to define a relatively large space at portions opposite to the first and second YIG thin film elements 23 and 24, the electromagnetically connected portion between the first and second strip lines 26 and 27 and the elements 23 and 24, and the connected portion between the third strip line 28 and the first and second strip lines 26 and 27.

The second conductor 22 is formed at its upper surface with a relatively shallow recess 31 to receive both the substrates 25 and 29 superimposed. Spacers 32 are located at both side edges of the bottom surface of the recess 31, so as to maintain a desired relatively small gap between the conductor 22 and an opposed portion of the YIG thin film elements 23 and 24 to the strip lines 26 and 27.

The ground terminal at both ends 28*a* and 28*b* of the third micro-strip line 28 is designed to contact with the lower surface 21*a* of the first conductor 21, while the ground terminal at each end 26*a* and 27*a* of the first and second micro-strip lines 26 and 27 is designed to contact with a base portion 22*a* of the second conductor 22 as located in the recess 31.

The bias magnetic field applying means 20 comprises a pair of barrel cores 41 and 42 surrounding the body 19 of the device. The barrel cores 41 and 42 have respective central magnetic poles 41A and 42A opposed to each other in such a manner as to interpose the body 19 therebetween. A coil 43 is wound around at least one of the central magnetic poles 41A and 42A. When the coil 43 is supplied with current, a D.C. bias magnetic field is generated between the central magnetic poles 41A and 42A, and a strength of the D.C. bias magnetic field may be varied by selecting the current to be supplied.

Figure 3:
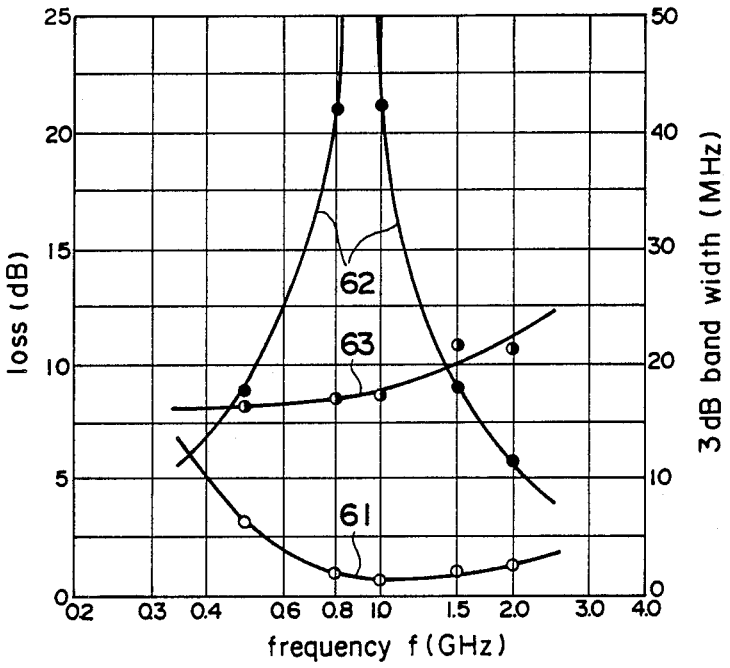
FIG. 3 is a graph showing filter characteristics with respect to frequencies of the preferred embodiment.

With the arrangement as mentioned above, magnetic connection between the YIG thin film elements 23 and 24 and the input and output strip lines 26 and 27 is strengthened to thereby sufficiently reduce the external Q value Qe. Accordingly, the operation frequency may be reduced. For instance, in using the YIG thin film elements 23 and 24 having a diameter of 2.5 mm and a thickness of 25 μm, the external Q value $Q_{e1}$ due to the connection between the input and output strip lines 26 and 27 and the YIG thin film elements 23 and 24 is 70, and the external Q value $Q_{e2}$ due to the connection between the connecting strip line 28 and the YIG thin film elements 23 and 24 is 325. FIG. 3 shows results of measurement of filter characteristics, in which curves 61, 62 and 63 designate an insertion loss, a reflection loss and a 3 dB band width, respectively. As is apparent from FIG. 3, the present invention may provide a variable frequency YIG band-pass filter which may be operated in a frequency range from 400 MHz to 2 GHz.

Figure 4:
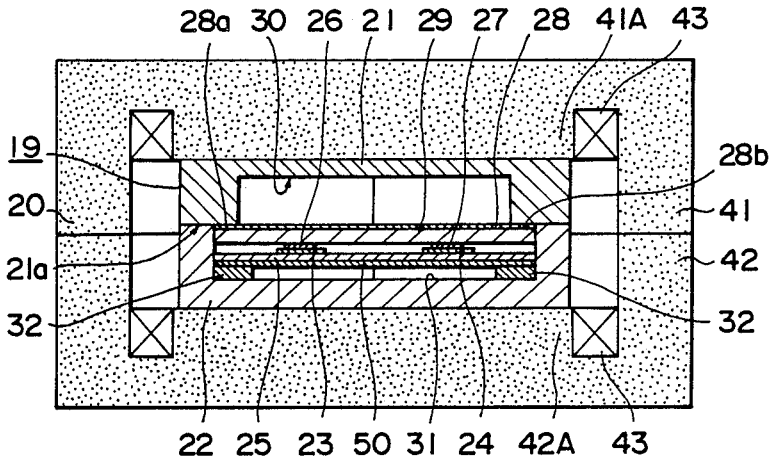
FIG. 4 is a sectional view of another embodiment of the present invention.

FIG. 4 shows another embodiment which may reduce the external Q value more than the previous embodiment. Referring to FIG. 4, the arrangement of this embodiment is similar to that of the previous embodiment shown in FIGS. 1 and 2, except that a conductor layer 50 is formed on an entire surface of the non-magnetic GGG substrate 25 on the opposite side of the YIG thin film elements 23 and 24, that is, on the surface of the substrate 25 opposed to the second conductor 23, which surface includes a portion opposed to at least the YIG thin film elements 23 and 24. The conductor layer 50 is kept in a floating condition where it is not electrically connected to the first and second conductors 21 and 22. The corresponding parts are designated by the same reference numerals as in FIG. 1, and explanation thereof is omitted herein.

Figure 5:
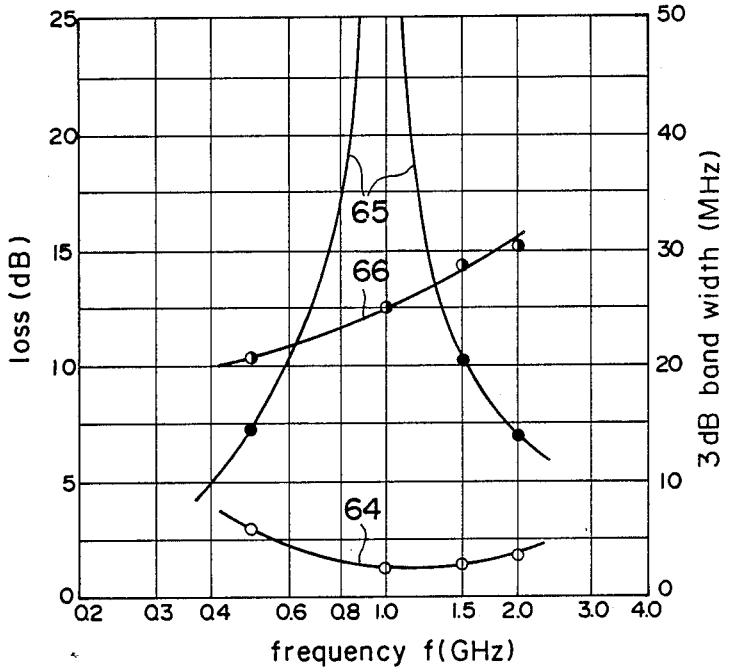
FIG. 5 is a graph showing filter characteristics with respect to frequencies of the embodiment shown in FIG. 5.

FIG. 5 shows results of measurement of filter characteristics with respect to frequencies, in which curves 64, 65 and 66 designate an insertion loss, a reflection loss and a 3 dB band width, respectively. In comparison with the characteristics of FIG. 3, the insertion loss is not so different from that in FIG. 3 since the filter of the previous embodiment shown in FIGS. 1 and 2 originally low in insertion loss. In contrast, the 3 dB band width of FIG. 5 is increased about 5 MHz more than that of FIG. 3. This result is due to the fact that the external Q value in FIG. 4 is reduced more.

Although the above embodiments employs the suspended substrate strip line arrangement, the present invention may include modified arrangements such as an infinite open type suspended substrate strip line arrangement where the first conductor 21 is sufficiently spaced away from the dielectric substrate 29, or an inverted micro-strip line arrangement.

As is described above, the present invention may achieve a ferromagnetic resonance device of a YIG thin film type which may be operated from an ultimately low frequency. Furthermore, a lower limit of resonance frequency may be sufficiently reduced. As a result, a unloaded Q value may be increased at the same frequency to thereby improve characteristics. Particularly, the effect is remarkable at low frequencies lower than 1 GHz.

Moreover, as mentioned with reference to FIGS. 1 and 2 and FIG. 4, the conductors 21 and 22 of the body 19 surround the resonance element to exhibit a shielding effect. Accordingly, when the body 19 is mounted in the gap between the magnetic poles 41A and 42A of the magnetic circuit of the bias magnetic field applying means 20, a change in characteristics due to isolation deterioration may be avoided by the shielding effect. Further, since the strip lines are formed on the dielectric substrate 29, and the YIG thin film elements 23 and 24 are formed on the non-magnetic substrate 25, the formation of the strip lines may be carried out independently of the formation of the YIG thin film elements, thereby simplifying a production process and improving a yield.

We claim as our invention:

1. A ferromagnetic resonance device comprising a YIG thin film element formed on a non-magnetic substrate, said YIG thin film element having a major surface coinciding with its (100) plane, a transmission line coupled to said YIG thin film element, and a bias magnetic field means applying a bias magnetic field perpendicular to said major surface.

2. A ferromagnetic resonance device comprising a YIG thin film element formed on a non-magnetic substrate, said YIG thin film element having a major surface coinciding with its (111) plane and having a uniaxial magnetic anisotropy constant Ku smaller than a uniaxial magnetic anisotropy of pure YIG thin film element formed on a GGG (gadolinium gallium-garnet) substrate, a transmission line coupled to said YIG thin film element, and a bias magnetic field means applying a bias magnetic field perpendicular to said major surface.

3. A ferromagnetic resonance device according to claims 1 or 2, wherein said YIG thin film element is formed in disk shape.

4. A ferromagnetic resonance according to claim 3, wherein said YIG thin film element has an aspect ratio not larger than $5\times10^{-2}$.

5. A ferromagnetic resonance device comprising:

a non-magnetic substrate, a ferrimagnetic thin film element formed on a major surface of said non-magnetic substrate, a strip line disposed on said non-magnetic substrate and electromagnetically coupled to said ferrimagnetic thin film element, a conductive wall of ground potential facing said strip line, and spaced at a predetermined distance therefrom, an end of said strip line being connected to said conductive wall of ground potential, and bias magnetic field means applying a D.C. magnetic field to said ferrimagnetic thin film perpendicular to said major surface thereof, said ferrimagnetic thin film element being formed of YIG thin film having a major surface coinciding with its (100) plane.

6. A filter device utilizing ferromagnetic resonance comprising:

a non-magnetic substrate, first, and second, ferrimagnetic thin film elements formed on a major surface of said non-magnetic substrate, a first strip line electromagnetically coupled to said first ferrimagnetic thin film element, a second strip line electromagnetically coupled to said second ferrimagnetic thin film element, a conductive wall of ground potential facing each of said first and second strip lines and spaced at a predetermined distance therefrom, an end of said first strip line being connected to an input circuit, and another end of said first strip line being terminated at said conductive wall of ground potential, an end of said second strip line being connected to an output circuit, and another end of said second strip line being terminated at said conductive wall of ground potential, said first and second ferrimagnetic thin film elements being magnetically coupled with each other, and bias magnetic field means applying a D.C. bias magnetic field to said ferrimagnetic thin film perpendicular to said major surface thereof, said ferrimagnetic thin film element being formed of YIG thin film having a major surface coinciding with its (100) plane.

7. A ferromagnetic resonance device according to claims 5 or 6, which further comprises a conductive layer formed on a surface opposite to said major surface of said non-magnetic substrate.

8. A ferromagnetic resonance device comprising a non-magnetic substrate, a ferrimagnetic thin film element formed on a major surface of said non-magnetic substrate, a strip line disposed on said non-magnetic substrate and electromagnetically coupled to said ferrimagnetic thin film element, a conductive wall of ground potential facing said strip line, and spaced at a predetermined distance therefrom, an end of said strip line being connected to said conductive wall of ground potential, and bias magnetic field means applying a D.C. magnetic field to said ferrimagnetic thin film perpendicular to said major surface thereof, said ferrimagnetic thin film element being formed of YIG thin film having a major surface coinciding with its (111) plane, and having a uniaxial magnetic anisotropy constant Ku smaller than the uniaxial anisotropy constant of pure YIG thin film element formed on a GGG substrate.

9. A filter device utilizing ferromagnetic resonance comprising:

a non-magnetic substrate, first and second, ferrimagnetic thin film elements formed on a major surface of said non-magnetic substrate, a first strip line electromagnetically coupled to said first ferrimagnetic thin film element, a second strip line electromagnetically coupled to said second ferrimagnetic thin film element, a conductive wall of ground potential facing each of said first and second strip lines and spaced at a predetermined distance therefrom, an end of said first strip line being connected to an input circuit, and another end of said first strip line being terminated at said conductive wall of ground potential, an end of said second strip line being connected to an output circuit, and another end of said second strip line being terminated at said conductive wall of ground potential, said first and second ferrimagnetic thin film elements being magnetically coupled with each other, and bias magnetic field means applying a D.C. bias magnetic field to said ferrimagnetic thin film perpendicular to said major surface thereof, said ferrimagnetic thin film element being formed of YIG thin film having a major surface coinciding with its (111) plane and having a uniaxial magnetic anisotropy constant Ku smaller than a uniaxial magnetic anisotropy constant of pure YIG thin film element formed on a GGG substrate.

10. A ferromagnetic resonance device according to claims 5 or 6, which further comprises a conductive layer formed on a surface opposite to said major surface of said non-magnetic substrate.

11. A filter device according to claims 6 or 9, wherein said first and second ferrimagnetic thin film elements are magnetically coupled by a transmission line.

12. A filter device according to claims 6 or 9, wherein said first and second ferrimagnetic thin film elements are magnetically coupled by a third ferrimagnetic thin film element provided between and adjacent to said first and second ferrimagnetic thin film elements.

13. A ferromagnetic resonance device comprising a YIG thin film element formed by LPE on a non-magnetic substrate, said YIG thin film element having a major surface coinciding with its (100) plane, a transmission line coupled to said YIG thin film element, and a bias magnetic field means applying a bias magnetic field perpendicular to said major surface.

14. A ferromagnetic resonance device comprising a YIG thin film element formed by LPE on a non-magnetic substrate, said YIG thin film element having a major surface coinciding with its (111) plane and having a uniaxial magnetic anisotropy constant Ku smaller than a uniaxial magnetic anisotropy of pure YIG thin film element formed on a GGG (gadolinium-gallium-garnet) substrate, a transmission line coupled to said YIG thin film element, and a bias magnetic field means applying a bias magnetic field perpendicular to said major surface.

* * * * *